United States Patent [19]

Deutscher et al.

[11] 4,116,878

[45] Sep. 26, 1978

[54] DETERGENT COMPOSITION

[75] Inventors: Fritz Deutscher, Mannheim; Robert Leitner, Ketsch, both of Fed. Rep. of Germany

[73] Assignee: Lever Brothers Company, New York, N.Y.

[21] Appl. No.: 735,365

[22] Filed: Oct. 26, 1976

Related U.S. Application Data

[63] Continuation of Ser. No. 584,306, Jun. 6, 1975, abandoned.

[30] Foreign Application Priority Data

Jun. 14, 1974 [LU] Luxembourg ..... 70322

[51] Int. Cl.[2] ..... C11D 3/395; C11D 7/54; C11D 1/14

[52] U.S. Cl. ..... 252/94; 252/541

[58] Field of Search ..... 252/541, 99, 94, 95

[56] References Cited

U.S. PATENT DOCUMENTS 3,458,446 7/1969 Diaz ..... 252/99

FOREIGN PATENT DOCUMENTS 1,144,675 3/1963 Fed. Rep. of Germany.
1,221,752 7/1966 Fed. Rep. of Germany.

*Primary Examiner*—Thomas J. Herbert, Jr.
*Attorney, Agent, or Firm*—Kenneth F. Dusyn; James J. Farrell; Melvin H. Kurtz

[57] ABSTRACT

A detergent composition with an improved bleaching efficiency and a reduced fabric-damage effect is obtained by inclusion of an alkalimetal monopersulphate as bleaching agent, an alkalimetal bromide as activator for that bleaching agent, and an amide-group containing compound such as urea as fabric-damage inhibitor.

2 Claims, No Drawings

DETERGENT COMPOSITION

This is a continuation, of application Ser. No. 584,306, filed June 6, 1975, now abandoned

BACKGROUND OF THE INVENTION

1. Field of the Invention

The present invention concerns a washing, bleaching and cleaning product that is particularly suitable for use at lower temperatures. The invention is particularly concerned with such products that comprise as bleaching agent an alkalimetal monopersulphate and as activator therefor an alkalimetal halogenide.

2. Description of the Prior Art

The published German patent application DAS No. 1,144,675 describes washing, bleaching and cleaning products comprising an alkalimetal monopersulphate and an alkalimetal halogenide. According to this publication halogen ions improve the bleaching action that is obtainable by means of the alkalimetal monopersulphate. This improvement is achieved by the addition e.g. of sodium chloride as the halogen-ion releasing compound.

The improvement of the bleaching effect is however not very marked and the object of the present invention is therefore to improve significantly the bleaching efficiency of the alkalimetal persulphates, in particular at lower temperatures.

U.S. Pat. No. 3,458,446 describes a scouring product which comprises an alkalimetal monopersulphate and a water-soluble bromide as activator therefor. According to this specification the addition of the bromide ensures a bleaching powder on hard surfaces that is far superior to that obtained by means of chloride.

On studying the alkali monopersulphate/alkali bromide system for bleaching fabrics, which is an application that is not mentioned in U.S. Pat. No. 3,458,446, it has been found that incorporating a bromide as activator for an alkalimetal monopersulphate does significantly improve the bleaching power on fabrics but simultaneously causes completely unacceptable damage to the fibres.

The object of the invention is therefore to provide a solution for the problem of the disadvantage of the damage to the fibres on using an alkalimetal monopersulphate as bleaching agent and a compound supplying bromide ions as activator for the alkalimetal monopersulphate.

According to the published German patent application DAS No. 1,221,752 it is known to add to an alkalimetal monopersulphate/alkalimetal chloride system a nitrogen-containing compound acting as chloride-hypochlorite acceptor. This system however contains an alkalimetal chloride in such an amount that particularly when in solution at a pH of 0–8 an undesirable amount of chlorine is released which is taken up by the nitrogen-containing compound. The amount of alkalimetal chloride used according to the published German patent application varies from 1 to 10 times the amount of alkali monopersulphate, whereas the small amount of alkali bromide according to the invention is considerably smaller.

SUMMARY OF THE INVENTION

It has now been found that the damage to fibres, which is caused by the system alkalimetal monopersulphate/bromide-ions supplying compound can be substantially decreased by adding a minor amount of a nitrogen-containing compound acting as bromide acceptor.

The present invention therefore relates to a washing, bleaching and cleaning product with a reduced fabric-damage effect, comprising an alkalimetal monopersulphate, an alkalimetal halogenide and a nitrogen-containing compound wherein the alkalimetal halogenide is alkali bromide.

DESCRIPTION OF THE PREFERRED EMBODIMENTS

The alkalimetal monopersulphate may be any persulphate, e.g. sodium or potassium monopersulphate. According to the invention a triple salt of the formula $KHSO_5$: $KHSO_4$: $K_2SO_4$ in a molar ratio of about 2:1:1, e.g. such as that sold by Degussa under the registered trade-name of Caroat or by Du Pont under the registered trade-name of Oxone, is preferred. The amount of alkalimetal monopersulphate to be used varies over a wide range according to the use intended for the product according to the invention. This amount varies from 1 to 80%, preferably from 5 to 60% and more particularly from 10 to 40% by weight.

The alkalimetal bromide may be any bromide, e.g. sodium or potassium bromide. Sodium bromide is preferred. The alkalimetal bromide is used according to the invention in an amount from 0.1 to 5% by weight, the weight ratio of alkalimetal monopersulphate to alkalimetal bromide being preferably higher than 1:1.

The nitrogen-containing compound used according to the invention should on the one hand decrease damage to the fibres without on the other hand undesirably affecting the bleaching power. In this connection it has been found that various nitrogen-containing compounds cited in the published German patent application DAS No. 1,221,752 do not meet these requirements. For instance, melamine negatively affects both bleaching power and damage to the fibres, and the sodium salt of sulphamic acid has appeared to be entirely unsuitable for decreasing the damage to the fibres.

Examples of suitable compounds for use in the invention are sulphamides, amides such as acetamide and urea.

It has been found that particularly nitrogen-containing compounds containing a —CO—$NH_2$ radical meet the desired criteria. The latter compounds and particularly urea are preferred. In general the nitrogen-containing compounds are used in an amount from 0.1 to 20% and preferably from 1 to 10% by weight.

The combination according to the invention may be used as such, but it may also be present in a conventional washing and cleaning product. Such washing and cleaning products comprise, besides the combination according to the invention, a detergent-active material and as the case may be builder salts and other additives.

In general the cleaning product may comprise from 2 to 20% by weight of an anionic detergent in the form of the sodium, potassium, ammonium or triethanolamine salts. Examples thereof are alkyl benzene sulphonates the alklyl radical of which has 12 to 18 carbon atoms, alkyl sulphates the alkyl radical of which has 10 to 24 carbon atoms, olefin sulphonates obtained by sulphonation of straight-chain alpha olefins having 10 to 20 carbon atoms followed by neutralization and hydrolysis of the sulphonation products, acylisethionates the acyl radical of which has 12 to 18 carbon atoms and acyltaurates the acyl radical of which has 12 to 18 carbon atoms. Moreover, the products according to the invention may comprise 1 to 10% by weight of a nonionic detergent. Examples thereof are the condensation products of alkylene oxide, for example ethylene oxide or propylene oxide with alcohols of which the alkyl radical has 12 to 24 carbon atoms, with alkyl phenols of which the alkyl radical has 8 to 18 carbon atoms, with fatty acid amides comprising a fatty acid radical with 10 to 24 carbon atoms, with polyalkylene glycols and with mixed alkyleneoxide condensation products.

The products according to the invention may also comprise an alkalimetal soap in an amount of 1 to 10% by weight. Examples thereof are alkalimetal (such as sodium of potassium) soaps of fatty acids with 12 to 22 carbon atoms such as fatty acids derived from palm oil, coconut oil, tallow and hardened fish oil.

For medium foaming the amount of the various detergents is 8 to 15% by weight of the anionic detergent, 1 to 6% by weight of the nonionic detergent, 1 to 5% by weight of the alkalimetal soap, whereas for low foaming the amounts are from 2 to 9% by weight of the anionic detergent, 2 to 10% by weight of the nonionic detergent and 5 to 10% by weight of the alkalimetal soap.

The balance of the product according to the invention can be formed by the usual constituents of washing and cleaning products. For instance, these products may comprise up to 50% by weight of a condensed phosphate such as pentasodium triphosphate. Part of the condensed phosphate may be replaced by an organic builder such as trisodium nitrilotriacetate.

Moreover, besides 0.5 to 3% sodium carboxymethyl cellulose or another suitable anti-redeposition agent, the products according to the invention may comprise 2 to 10% sodium silicate.

Furthermore, the products according to the invention comprise inorganic alkalimetal salts such as sodium-sulphate, -carbonate, -borate or -orthophosphate, sodium hydroxide and also other (preferably chlorine-stable) additives such as anti-tarnishing agents, perfumes (preferably chlorine-stable), germicides, colouring agents, foam-modifying agents, fluorescers (preferably chlorinestable), solvents etc.

The products according to the invention are particularly suitable for bleaching at lower temperatures, to wit 30° to 60° C. It has been found that even at high pH values, viz higher than 8, a distinctly improved bleaching power and a distinctly decreased fibre damage are achieved; the use of sodium hydroxide to adjust the pH in that range yields better results than those obtained e.g. by means of trisodium orthophosphate or sodium carbonate. In general the best results are obtained at a pH from 8 to 11. The invention will be further illustrated by the following Examples.

EXAMPLE I

Standard cotton Krefeld test cloths were washed in a Tergotometer with various compositions and the chemical damage to the fibers was determined. The bleaching power on cotton fabrics, stained by tea, was determined.

The operating conditions in the Tergotometer were as follows:

Time/temperature : 8 minutes to 60° C., 40 minutes at 60° C.

Water hardness : 12° German hardness

Cloth/liquor ratio: 1:100

Number of washes : 10 (for fibre damage tests) 1 (for bleaching power)

The bath contained per litre the additives mentioned in the Table given below.

The chemical damage to the fibres was determined by measuring the decrease of the average polymerization degree (DP) determined by viscosimetry.

The damaging factor = DF =

$$\frac{\log\left(\frac{2000}{\text{DP after damage}} - \frac{2000}{\text{initial DP}} + 1\right)}{\log 2}$$

was measured according to DIN 44983.

The bleaching or brightening efficiency Δ R was measured by means of the Zeiss Elrepho reflectometer.

In the following Table, OM stands for a spray-dried heavy-duty detergent sold under the trade-name of OMO and TM stands for a wash liquor containing per liter 0.5 g of a secondary $C_{11}$–$C_{15}$ alcohol condensed with 9 moles of ethylene oxide and 3.0 g sodium tripolyphosphate. Alkali was added to the liquor in an amount required for adjusting the pH. The product sold under the trade-name Caroat by the firm of Degussa is the triple salt $KHSO_5$: $KHSO_4$ : $K_2SO_4$ (2:1:1).

TABLE

| Washing product (g) | Alkali | Caroat (g) | NaBr (g) | Nitrogen-containing compound (g) | pH | Brightening ΔR | DF |
|---|---|---|---|---|---|---|---|
| 8.0OM | $Na_3PO_4$ | 2.0 | 1.0 | — | 10.1 | 45.0 | fabric totally destructed |
| 8.0 OM | $Na_3PO_4$ | 2.0 | 1.0 | 2.0 urea | 9.8 | 27.4 | 0.4 |
| 8.0 OM | $Na_3PO_4$ | 1.0 | 1.0 | 2.0 urea | 9.9 | 21.2 | 0.5 |
| 8.0 OM | $Na_3PO_4$ | 1.0 | 0.5 | 2.0 urea | 9.9 | 24.0 | 0.3 |
| 8.0 OM | $Na_3PO_4$ | 1.0 | 0.5 | 1.0 urea | 9.9 | 24.3 | 0.4 |
| 6.5 OM | $Na_2CO_3$ | 1.5 | 0.75 | 1.5 urea | 9.1 | 20.2 | 0.2 |
| 4.7 OM | $Na_2CO_3$ | 1.1 | 0.55 | 1.1 urea | 9.1 | 18.3 | 0.24 |
| 7.0 OM | $Na_2CO_3$ | 1.0 | 0.5 | 1.0 urea | 9.2 | 19.0 | 0.24 |
| 5.25 OM | $Na_2CO_3$ | 0.75 | 0.37 | 0.75 urea | 9.2 | 17.1 | 0.33 |
| 6.0 OM | $Na_2CO_3$ | 2.0 | 0.7 | 0.3 urea | 8.9 | 22.1 | 0.14 |
| 6.0 OM | $Na_2CO_3$ | 2.0 | 0.5 | 0.5 urea | 8.9 | 23 | 0.2 |
| 5.2 OM | $Na_2CO_3$ | 2.4 | 0.6 | 0.6 urea | 8.8 | 24 | 0.2 |
| 7.45 OM | NaOH | 1.5 | 0.1 | 0.5 urea | 10.0 | 39.2 | 0.65 |
| 7.35 OM | NaOH | 1.5 | 0.2 | 0.5 urea | 10.0 | 38.2 | 0.6 |
| 7.45 OM | NaOH | 1.5 | 0.1 | 0.5 urea | 9.6 | 37.2 | 0.6 |
| 7.75 OM | NaOH | 1.0 | 0.5 | 0.5 urea | 9.8 | 24.2 | 0.4 |
| 6.5 OM | NaOH | 2.0 | 0.5 | 0.5 urea | 9.8 | 37.3 | 0.6 |
| 6.5 OM | NaOH | 1.5 | 0.1 | 0.5 urea | 9.2 | 32.4 | 0.6 |
| TP | $Na_3PO_4$ | 2.0 | 1.0 | 2.0 urea | 10.1 | 30 | 0.7 |
| TP | $Na_3PO_4$ | 2.0 | 1.0 | 2.0 acetamide | 10.1 | 30 | 0.5 |
| TP | $Na_3PO_4$ | 2.0 | 1.0 | 2.0 mela- | 10.2 | 27 | 2.0 |

TABLE-continued

| Washing product (g) | Alkali | Caroat (g) | NaBr (g) | Nitrogen-containing compound (g) | pH | Brightening ΔR | DF |
|---|---|---|---|---|---|---|---|
| | | | | mine | | | |

These results clearly show that the combination according to the invention causes less damage to the fibres and exerts a satisfactory bleaching effect and also clearly show the favourable influence of sodium hydroxide on the bleaching power.

EXAMPLE II

The washing product according to the invention was tested in an AEG REgina de Luxe "Bio" washing machine to determine the bleaching and washing power. The washing was carried out in a cycle comprising two baths at 60° C., the hardness of the water being 12° German hardness.

The washing agent consisted of 20 parts of Caroat(R), 2 parts of NaBr, 5 parts of urea, 10 parts of sodium metasilicate and 63 parts of the following composition:

5% of a condensation product of 1 mol of a straight chain alcohol with 16 to 18 carbon atoms and 12 mol ethylene oxide
10% sodium dodecyl benzene sulphonate
4% tallow sodium soap
1% sodium carboxymethyl cellulose
50% sodium tripolyphosphate
8.5% sodium tetrapyrophosphate
1.6% sodium orthophosphate
6% sodium metasilicate ($Na_2O:SiO_2$ 1:3.5)
1% sodium hydroxide
1% magnesium silicate
0.2% sodium ethylene diamine tetraacetate
0.2% optical bleaching agent
11.6% water and salts The dose for the pre-wash was 200 g and for the main wash 150 g. The pH in the pre-wash was 9.6.

The washing efficiency on experimentally soiled standard fabrics AS 8 and the brightening power on tea-stained fabrics was determined.

The results were as follows:

| | | |
|---|---|---|
| Washing efficiency on fabric AS 8 | :20 points | after one wash |
| Brightening power on tea-stained fabric | :24 points | after one wash |
| Damaging factor after 10 washes | :0.25 | after one wash |

EXAMPLE III

The bleaching power of the following compositions on cotton fabrics stained with tea was determined in Tergotometer. The operating conditions in the Tergotometer were as follows:

Time/temperature : 8 minutes to 60° C., 20 minutes at 60° C.
Water hardness : 12° German hardness
Cloth/liquor ratio : 1 : 100
Number of washes : 1

The batch contained per liter 0.5 g of a condensation product of 1 mol of a $C_{11}$–$C_{15}$ secondary alcohol with 9 moles ethylene oxide and 3 grams sodium tripolyphosphate.

The compositions and the brightening obtained therewith are represented in the following Table.

| Caroat (g/l) | NaBr (g/l) | NaCl (g/l) | Urea (g/l) | pH | |
|---|---|---|---|---|---|
| 1.0 | 0.2 | — | — | 0.5 | 42.2 |
| 1.0 | — | 0.2 | — | 9.5 | 16.9 |
| 1.0 | 0.2 | — | 1.0 | 10.1 | 28.1 |
| 1.0 | — | 0.2 | 1.0 | 10.1 | 16.4 |

These results clearly show that the products according to the invention are superior to systems containing chloride as activator.

What we claim is:

1. A detergent and bleaching composition having a reduced fabric damaging effect consisting essentially of
(a) from 2 to 20% by weight of an anionic detergent compound selected from the group consisting of the sodium and potassium salts of $C_{12}$–$C_{18}$ alkylbenezenesulphonic acids, $C_{10}$–$C_{24}$ alkylsulphuric acid esters, $C_{10}$–$C_{20}$ olefinsulphonic acids, $C_{12}$–$C_{18}$ acylisethionic acids and $C_{12}$–$C_{18}$ acyltaurines;
(b) from 1 to 80% by weight of sodium or potassium monopersulphate;
(c) from 0.1 to 5% by weight of sodium or potassium bromide; and
(d) from 0.1 to 20% by weight of urea or acetamide; the weight ratio of the sodium or potassium monopersulphate to the sodium or potassium bromide being higher than 1:1, and the total composition having a pH of from 8 to 11.

2. A composition according to claim 1, comprising 10–40% by weight of the sodium or potassium monopersulphate, 0.1–5% by weight of sodium or potassium bromide and from 1–10% of urea or acetamide.

* * * * *